US005299926A

United States Patent [19]

Nakajima et al.

[11] Patent Number: 5,299,926

[45] Date of Patent: Apr. 5, 1994

[54] SPINNING APPARATUS HAVING A TUBULAR ELASTOMERIC FLOW CONTROL VALVE BODY

[75] Inventors: Shigeru Nakajima, Okayama; Tadao Marui, Kobe, both of Japan

[73] Assignee: Sumika-Hercules Co., Ltd., Osaka, Japan

[21] Appl. No.: 965,784

[22] Filed: Oct. 23, 1992

[30] Foreign Application Priority Data

Oct. 24, 1991 [JP] Japan ..... 3-306994

[51] Int. Cl.[5] ..... D01D 5/08; D01F 6/18

[52] U.S. Cl. ..... 425/71; 425/DIG. 19; 264/182; 264/187; 264/203

[58] Field of Search ..... 264/180, 178 F, 187, 264/178 R, 206, 177.13, 184, 211.12, 182, 211.14, 203; 425/72.2, 72.1, 389, DIG. 19, 382.4, 381.2, 382.2, 71, 378.2, 69

[56] References Cited

U.S. PATENT DOCUMENTS

| | | | |
|---|---|---|---|
| 2,636,217 | 4/1953 | Hammond et al. | 264/206 |
| 3,002,804 | 10/1961 | Kilian | 264/178 F |
| 3,431,336 | 3/1969 | Isobe et al. | 264/180 |
| 4,340,563 | 7/1982 | Appel et al. | 425/72.2 |
| 4,626,183 | 12/1986 | Shirai et al. | 425/DIG. 19 |
| 4,780,073 | 10/1988 | Katsumi et al. | 264/211.14 |
| 4,838,774 | 6/1989 | Balk | 425/72.2 |
| 4,863,662 | 9/1989 | Hasegawa et al. | 264/178 F |
| 5,149,480 | 9/1992 | Cuculo et al. | 264/178 F |

FOREIGN PATENT DOCUMENTS

| | | | |
|---|---|---|---|
| 41-4807 | 2/1966 | Japan | 264/180 |
| 45-2765 | 1/1970 | Japan | 264/180 |
| 62-42822 | 2/1987 | Japan | 264/180 |
| 539992 | 6/1975 | U.S.S.R. | 264/184 |

*Primary Examiner*—Jay H. Woo
*Assistant Examiner*—Duane S. Smith
*Attorney, Agent, or Firm*—Wenderoth, Lind & Ponack

[57] ABSTRACT

A novel spinning apparatus is provided with a tubular coagulating liquid flow control valve body made of an elastomeric material and whose inner diameter is changeable according to external pressure. The valve body has a simple structure and is easy to retrofit to a conventional spinning apparatus. When dope is extruded, a mass of dope with gelled skin can pass easily and quickly through the opened valve body so that the spinning workability at the start of spinning is high. Further, since the coagulating liquid flows smoothly, the spinning speed can be increased without damaging the filaments.

3 Claims, 4 Drawing Sheets

SPINNING APPARATUS HAVING A TUBULAR ELASTOMERIC FLOW CONTROL VALVE BODY

BACKGROUND OF THE INVENTION

1. Field of the Invention

The present invention relates to a spinning apparatus incorporated in a man-made fiber manufacturing machine and an air-gap spinning method, and more specifically to a spinning apparatus provided with a vertical flow type coagulation bath having a novel coagulating liquid flow control unit and an air-gap spinning method of manufacturing acrylic fibers or cellulosic fibers, useful as a carbon fiber precursor by means of the same spinning apparatus.

2. Description of the Prior Art

In general, man-made fiber is manufactured by a melt spinning method, dry spinning method, wet spinning method, etc. according to the properties of the raw materials.

The above-mentioned spinning methods have been improved in turn, and in particular the melt spinning technique has been improved markedly, so that recently various high performance fibers can be manufactured at a high spinning speed.

Although applicable to thermoplastic polymers such as polyamides or polyesters, this melt spinning technique is not applicable to raw materials which will not be melted by heat, such as cellulosic, polyacrylonitrilic polymers, etc. Accordingly, cellulosic or polyacrylonitrilic fiber has been now manufactured in accordance with the wet spinning method, in particular or the dry spinning method.

These dry and wet spinning techniques have not been improved markedly in spite of various efforts, as compared with the melt spinning technique. In the wet spinning technique, in particular, the spinning speed is extremely low because the spinning dope or polymer solution must be directly extruded into a coagulating liquid. To overcome this problem, an air-gap spinning technique has been proposed such that the spinning dope is extruded through a spinneret and then passed through air before being introduced into a coagulating liquid, with the result that the spinning speed has been improved to a considerable extent.

In the above-mentioned air-gap spinning method, it is necessary to pass the extruded liquid-state fiber of spinning dope through the coagulation bath in order to coagulate the liquid-state fiber quickly and uniformly. In more detail, the spinneret must be located over the coagulating liquid; the spinning dope must be extruded downward through the spinneret so that the spinning dope can be coagulated in contact with the coagulating liquid; and the coagulated fiber bundle must be taken out of the coagulation bath thus being problematic in that the spinning apparatus requires a complicated structure and further the workability or the productivity is less than when either the dry or melt spinning method is employed.

In other words, the spinning dope extruded through the spinneret inevitably becomes a mass of dope with gelled skin whenever the dope is extruded, so that the workability at the start of spinning is deteriorated. Here, the start of spinning implies the process from when the spinning dope is extruded through the spinneret into an inert medium (under the condition that the spinning apparatus including the coagulation bath and the first Godet roller operated immediately after the coagulation process are both ready for operation) to when the extruded liquid-state fiber is introduced into the coagulation bath and then the coagulated fiber bundle is taken out of the coagulation bath and is taken up around the first Godet roller. In this spinning start process, the extruded liquid-state fiber is often accumulated at the surface of coagulating liquid, that is, a mass of dope with gelled skin, without being coagulated quickly, is formed.

To improve the spinning start workability, there has been proposed a coagulation bath for air-gap spinning method which is provided with a direction change guide as disclosed in Japanese Published Unexamined (Kokai) Patent Application No. 1-183511. In this proposed method, since the mass of dope with gelled skin produced when the dope is extruded is taken outside the coagulation bath by the direction change guide, the workability can be improved to some extent. However, there exists a shortcoming in that since the coagulated fiber bundle is not yet completely coagulated in the coagulation bath, the filament is subjected to damage due to the friction generated between the filament and the direction change guide. In this method, when the guide is replaced with a rotatable roller, it may be possible to reduce the damage of the coagulated fiber bundle. However, there raises another problem in that the filament is easily wrapped around the roller or the apparatus assumes a rather complicated mechanical structure.

On the other hand, a funnel-type coagulation tube provided with a coagulating liquid flow control unit has been also proposed, as disclosed in Japanese Published Unexamined Patent Application No. 51-35716. According to the method disclosed in this publication the mass of dope with gelled skin produced at the start of spinning is passed through an open valve of the coagulating liquid flow control unit, and the degree of opening of the valve is controlled after the coagulated fiber bundle has been passed through the valve. Further, in this prior art, a few embodiments of controlling the degree of opening of the valve of the coagulating liquid flow control unit have been proposed as follows: (1) the degree of opening of the valve is controlled by use of a shutter similar to that used in a camera, that is, by reducing the diameter of the opening from the circumference toward its center; (2) the degree of opening is controlled by shifting a plate formed with a round notch toward the center of the valve opening; and (3) the degree of opening is controlled by shifting two plates each formed with a round hole, respectively, in two opposite directions, respectively. In any of these embodiments, the degree of opening of the valve is controlled by interrupting the liquid flow, that is, by shifting a control member in the horizontal direction relative to the vertical flow direction of the coagulating liquid.

Accordingly, when the liquid flow is interrupted by shifting the control member in the horizontal direction against the vertical flow direction, there exists a problem in that vortices will be produced in the coagulating liquid in front and to the rear of the opening control member, so that the filament alignment of the semicoagulated-state fiber bundle traveling together with the coagulating liquid is disturbed or the filament is damaged. Therefore, when the filament thus obtained is to be used as a carbon fiber precursor, there arises a problem in not only can it not be possible to obtain a high performance carbon fiber, but also the spreadability of the fiber bundle is not satisfactory due to the deterioration of the filament alignment, in the case where a resin impregnated prepreg sheet is required to be manufactured, for instance.

In addition, the coagulating liquid flow control unit as described above has a complicated structure, and therefore the operability is not satisfactory.

SUMMARY OF THE INVENTION

With these problems in mind, therefore, it is the primary object of the present invention to provide a novel spinning apparatus and a novel air-gap spinning method which are excellent in operability, prevent damage of the semicoagulated fiber bundle, and offer high filament alignment.

To achieve the above-mentioned object, the spinning apparatus according to the present invention is characterized in that a tubular coagulating liquid flow control valve body made of an elastomeric material is provided in such a way that the diameter of the valve body can be controlled by external pressure. The elastomeric material is natural rubber or synthetic rubber, and the elastic modulus of the material lies preferably within a range from 3 $Kg/cm^2$ to 50 $Kg/cm^2$. Similarly, to achieve the above-mentioned object, the air-gap spinning method is characterized in that the diameter at the neck of the tubular coagulating liquid flow control valve body is controlled by external pressure.

BRIEF DESCRIPTION OF THE DRAWINGS

The present invention will be described hereinbelow in more detail with reference to the attached drawings, in all of which the valve body is shown in such shape as obtained under the normal pressure and wherein.

DETAILED DESCRIPTION OF THE PREFERRED EMBODIMENTS

Figure 1:
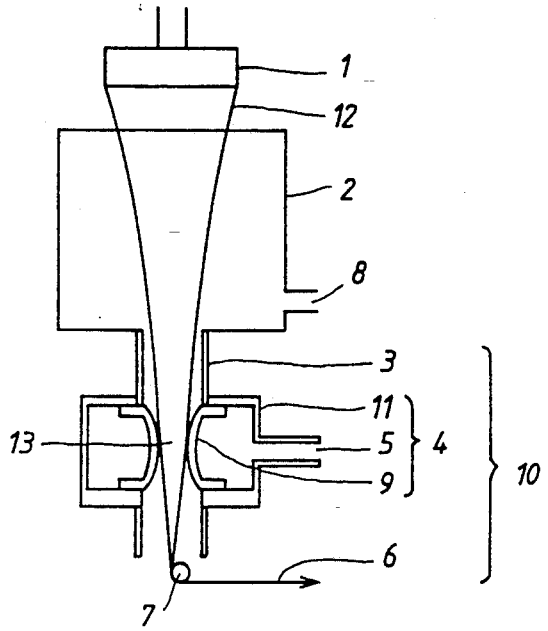
FIG. 1 is a longitudinal cross-sectional view of an embodiment of the spinning apparatus of the present invention provided with a vertical flow type coagulation bath, in which neither a spinning dope supplying apparatus arranged before the spinneret nor a first Godet roller arranged after the direction change guide are shown.

The embodiment of the present invention will be described hereinbelow. Prior to the description thereof, a vertical flow type coagulation bath to which the present invention is applied will be first explained. FIG. 1 is a cross-sectional view showing an example of the spinning apparatus provided with a vertical flow type coagulation bath.

In FIG. 1, a coagulating liquid is supplied from a coagulating liquid supply pipe 8 to a coagulation bath 2, and then flows in the downward direction through a flow pipe 3 together with a coagulated fiber bundle 6 passing through a tubular coagulating liquid flow control valve 9 (referred to as valve body simply, hereinafter) of a coagulating liquid flow control unit 4. Thereafter, the coagulating liquid is drained thereby being separated from the coagulated fiber bundle 6 at a direction change guide 7 disposed under the bottom of the coagulation apparatus 10. As described above, since the coagulating liquid within the coagulation bath 2 flows downward, the portion of the apparatus from the coagulation bath 2 to the direction change guide 7 is referred to as the vertical flow type coagulation bath, in this embodiment. Further, the portion apparatus arranged below the coagulation bath 2, that is, from the flow pipe 3 to the direction change guide 7, is sometimes called generically the bottom of a coagulation apparatus 10. In this connection, the spinning apparatus includes generally a spinning dope supplying unit (not shown), a spinneret 1, and the coagulation bath 2. Further, in FIG. 1, the flow pipe 3 and the direction change guide 7 are not essential elements related to the present invention.

The spinning apparatus according to the present invention is characterized in that the vertical flow type coagulation bath 2 is provided with the coagulating liquid flow control unit 4, and further in that the valve body 9 made of a specific material is provided for the coagulating liquid flow control unit 4. In more detail, as shown in FIG. 1, the coagulating liquid flow control unit 4 comprises the valve body 9 and a casing 11 formed with a working medium supply pipe 5 for decompression or pressurization . The valve body 9 must be formed of an elastomeric material. Further, FIG. 1 shows the state of the valve body 9 under the normal or atmospheric pressure, that is, under the condition that no specific pressure is applied to the valve body 9 through the working medium supply pipe 5.

At the start of spinning, as already described, state dope is extruded from the spinneret 1 into an inert medium 12 and is then introduced into the coagulation bath 2. At this step, the dope inevitably become a mass of dope with gelled skin. The diameter of the mass of dope is larger, as a matter of course, than that of the coagulated fiber bundle normally drawn together with the vertically flowing coagulating liquid. The mass of dope with gelled skin of a large diameter cannot pass through the prior art coagulating liquid flow control unit, thus raising various problems as already described. In the present invention, however, it is possible to smoothly pass the spinning dope or the polymer solution therethrough as follows.

At the start of spinning, the diameter of the neck 13 of the valve body 9 is increased by reducing the pressure in the casing 11 through the working medium supply pipe 5, with the result that the mass of dope with gelled skin can be easily passed through the neck 13 expanded by the reduction in pressure. The direction of travel of the mass of dope with gelled skin is changed by the direction change guide 7, and is then introduced into the first Godet roller (not shown) disposed immediately downstream of the spinning apparatus so as to be taken out at a constant speed.

Under these conditions, the spinning dope traveling through the vertical flow type coagulation bath 2 is not the mass of dope with gelled skin but a coagulated fiber bundle. Here, the pressure on the valve body 9 is brought up to atmospheric pressure so that the neck 13 of the valve body 9 is elastically returned to its original shape, that is, the diameter of the neck is restored (decreased).

Accordingly, it is possible to maintain a designed flow rate of the coagulating liquid. As described above, after the start of spinning, a steady state air-gap spinning is maintained. In the steady state air-gap spinning operation, it is of course possible to reduce the flow rate of the coagulating liquid by reducing the diameter of the valve 9, that is, by applying a pressurized working medium through the working medium supply pipe 5.

To achieve the above-mentioned function, it is necessary to form the valve body 9, which constitutes the essential portion of the apparatus, of an elastomeric material. In the above description, although a case has been described in which the diameter at the neck 13 of the valve body 9 is expanded by reducing the pressure at the start of spinning, normal or atmospheric pressure can be applied at the start of spinning and thereafter a pressurized working medium can be supplied to decrease the diameter of the valve body 9 at the steady state operation according to necessity.

The valve body is tubular so that the mass of dope with gelled skin or the coagulated fiber bundle can pass through the opening portion at the neck 13 formed at roughly the middle portion of the valve body 9. Without being limited thereto, however, the valve body 9 can have various shapes, for instance cylindrical, square-shaped, compressed or constricted, etc. FIGS. 5 to 10 show some modifications of the shape of the valve body 9.

As already described, the material of the valve body 9 which constitutes the essential portion of the coagulating liquid flow control unit 4 is an elastomeric material. The material can be selected from the group of natural rubber, diene rubber (e.g. styrene-butadiene rubber, butadiene rubber, isoprene rubber, chloroprene rubber, acrylonitrile-butadiene rubber, etc.), olefine rubber (e.g. butyl rubber, ethylene-propylene rubber, ethylene-vinyl acetate rubber, chlorosulfonic polyethylene rubber, acrylic rubber, etc.), and synthetic rubber (e.g. urethane rubber, silicone rubber, fluororubber, polysulfide rubber, etc.). Further, it is of course possible to add ordinary additives to these rubber materials.

Further, the deformation modulus or the elastic modulus of the material is not determined simply and absolutely because it is dependent upon the shape and the dimensions of the valve body and the pressure of the working medium. However, the preferable range of the elastic modulus of the valve body 9 is between 1 and 100 $Kg/cm^2$, and more preferably between 3 and 50 $Kg/cm^2$.

Although being dependent upon the shape and the dimensions of the valve body, if the elastic modulus is excessively low, the diameter of the valve body 9 changes by the pressure caused by differences in the liquid level of the coagulation bath so that the flow rate of the coagulating liquid increases excessively when the liquid level is high, for instance. In addition, the diameter thereof is changed by contact with the coagulated fiber bundle, or it becomes difficult to control the diameter by external pressure. On the other hand, if the elastic modulus of the valve body 9 is excessively high, since the shape of the valve body 9 is not easily deformed by an external pressure, the diameter of the valve body is not reliably controlled so that the mass of dope with gelled skin will not be passed therethrough at the start of the spinning operation, thus disabling the spinning operation itself. Although being dependent upon the elastic modulus of the material, the thickness of the valve body 9 formed of the material exhibiting the elasticity of rubber generally ranges from 0.3 to 5 mm, and more preferably from 0.5 to 3 mm. The working medium for controlling the diameter of the valve body 9 can be any liquid (e.g. water, oil, etc.) or gas (e.g. air, nitrogen, etc.). However, air is most suitable.

Here, elastomeric means that the stress-strain relationship is linear over a wide deformation range, and the strain is reduced down to zero immediately after the stress is removed without having any permanent deformation or any plastic deformation, which is referred to as entropy elasticity in technical terms.

Further, the shape of the coagulating liquid flow control unit 4 provided with the valve body 9 according to the present invention is not at all limited as long as the control unit 4 can be provided with the valve body 9 and the working medium supply pipe 5, and the coagulating liquid will not leak from the unit during compression or pressurization except at the bottom opening of the valve body. That is, it is not important to bond the valve body 9 to the control unit 4 or form both integrally as a single unit.

Further, the coagulating liquid flow control unit 4 on which the valve body 9 according to the present invention is mounted can be located anywhere along the bottom of the coagulation apparatus 10. However, it is preferable to locate the control unit 4 at the middle of the bottom of the coagulation apparatus 10 from the standpoints of workability and stability. When multistep coagulation is implemented, it is preferable to immerse the bottom of the coagulation apparatus 10 or the whole coagulation liquid control unit 4 onto the coagulation bath of the downstream apparatus.

In the spinning method according to the present invention, valve body 9 formed of a material exhibiting the elasticity of a rubber, is controlled by external pressure so that the diameter of the valve body can be regulated.

More specifically, first the opening at the neck 13 of the valve body 9 is expanded by reducing the pressure exerted thereon with a pressure reduction unit (e.g. a vacuum pump or an air ejector) such that the working medium is evacuated from the casing 11 through the working medium supply pipe 5 (decompression) until the pressure is less than the normal or atmospheric pressure. This is a spinning start standing-by-state.

The spinning dope (not shown) is extruded from the spinneret 1 into the inert medium 12 and is then introduced into the coagulation bath 2 in accordance with the ordinary air-gap spinning method. In this case, although the spinning dope becomes a mass of dope with gelled skin rather than a coagulated fiber bundle within the coagulation bath, as already described, since the diameter at the neck 13 of the valve body 9 is kept expanded, the spinning dope can pass smoothly therethrough together with the downward flowing coagulating liquid without clogging the valve body 9. The mass of dope with gelled skin is immediately taken up by the first Godet roller (not shown) via the direction change guide 7.

Once the taking up operation of the Godet roller starts, since the spinning dope converts from a mass of dope with gelled skin to a coagulated fiber bundle within the coagulation bath 2, it is no longer necessary to maintain the valve body 9 in the expanded condition, and therefore the spinning start operation ends.

For the steady state operation, the diameter of the neck 13 of the valve body 9 is reduced by relieving the reduced pressure state within the valve casing 11 or by applying an appropriate working medium under pressure through the working medium supply pipe 5 according to the coagulating liquid flow rate. Further, the air-gap distance in the inert medium 12 is set again to a predetermined value, and other necessary conditions are all set.

Thereafter, the coagulated fiber bundle 6 introduced to the first Godet roller is washed by water, stretched, heat-treated, oiled or finished, etc. in accordance with the ordinary processing procedure.

Some examples will be described hereinbelow to facilitate a better understanding of the present invention. However, these examples do not limit the scope of the present invention. In the following description, the percentage % and the part indicate the weight percentage or the weight part, as far as not being specified.

EXAMPLE 1

The tubular coagulating liquid flow control valve body 9 was made of a silicone rubber with an elastic modulus of 20 Kg/cm$^2$ and a thickness of 1 mm. The valve body 9 had both the inlet and outlet side internal diameters of 30 mm and a neck 13 having an internal diameter of 15 mm. The casing 11 includes 7-mm diameter working medium supply pipe 5 of a plastic material. The valve body 9 was attached to the casing 11 to provide the coagulating liquid flow control unit 4. The control unit 4 thus obtained was fixedly bonded to the lower end of the flow pipe 3 of the bottom of the prior art coagulation apparatus 10. Further, a vacuum apparatus (not shown) was connected to the working medium supply pipe 5 to complete the spinning apparatus of the present invention.

The air-gap spinning method of acrylic fiber was effected by use of the spinning apparatus according to the present invention in accordance with the ordinary procedure. In more detail, 15 part copolymer composed of 98% acrylonitrile and 2% methacrylic acid was dissolved to a 85 part aqueous solution of 53% sodium thiocyanate to obtain a spinning dope. The obtained spinning dope was extruded into air through a spinneret 1 with an inner diameter 0. 15 mm and a hole number of 1500 and thereafter introduced into the coagulation bath 2 filled with a coagulating liquid of 12% sodium thiocyanate aqueous solution. During this step, a reduced pressure (100 mmHg in absolute pressure) was applied to the valve body to expand the inner diameter (up to 22 mm) at the neck 13 of the valve body 9.

The mass of dope with gelled skin formed within the coagulation bath was smoothly passed through the valve body, so that spinning was started easily. Thereafter, the casing 11 was placed under atmospheric pressure to initiate the steady state operation. The liquid surface of the coagulation bath 2 was extremely stable during the spinning process without causing any ruffle.

The obtained coagulated fiber bundle was washed with water, stretched, and dried, before wrapping. The number of broken filaments representative of the degree of the filament damage of the cheese or package per unit areas was as excellent as 0 filaments/m$^2$. Further, a spreadability test was conducted. The test results indicated that the spreadability was sufficient and the filament alignment was also excellent.

The obtained fiber bundle was oxidized at 240° to 260° C. within an air atmosphere, and then carbonized at the maximum temperature of 1350° C. within an inert gas atmosphere to obtain carbon fibers. The tensile strength of an epoxy resin impregnated strand was measured in accordance with the method prescribed by JIS R-7601. The measured result was as good as 591 Kg/mm$^2$.

EXAMPLE 2

The valve bodies listed in the table below (different from Example 1 in material, material elastic modulus, and material thickness) were used in the method of Example 1, and the same spinning tests as described with respect to Example 1 were effected under the same conditions. The table also lists the spinning start workability, the liquid level stability of the coagulation bath, the number of broken filaments per unit area, and the tensile strength of the strand.

TABLE

| VALVE MATL | ELAST MODUL Kg/cm$^2$ | VALVE THK mm | SPIN START WORK | LIQ. LEVEL STAB | BROKEN FILS/ m$^2$ | STRAND STRENGTH Kg/mm$^2$ |
|---|---|---|---|---|---|---|
| SI RUB. | 5 | 2 | ∘ | ◎ | 10 | 566 |
| | 11 | 2 | ◎ | ∘ | 6 | 583 |
| | 18 | 2 | Δ | ∘ | 3 | 594 |
| | 8 | 1 | ∘ | ∘ | 7 | 568 |
| | 11 | 1 | ◎ | ◎ | 5 | 580 |
| | 32 | 1 | Δ | ◎ | 3 | 541 |
| NAT RUB. | 20 | 1 | ◎ | ◎ | 11 | 585 |

◎: Very good; ∘: Good; Δ: Probably good

The above table indicates that the spinning start workability, the liquid level stability of the coagulation bath, the number of broken filaments, and the tensile strength of the epoxy resin impregnated strand are all fairly good, and therefore the physical properties of the carbon fiber bundles are excellent, in the case of the spinning method carried out by the spinning apparatus of the present invention.

COMPARATIVE EXAMPLE

Figure 2:
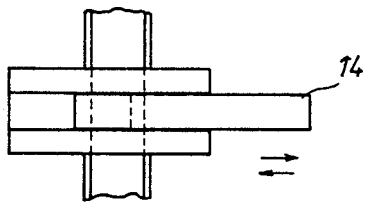
FIG. 2 is a longitudinal cross-sectional view of a prior art coagulating liquid flow control unit of the type employing a plate formed with a notch.
Figure 3:
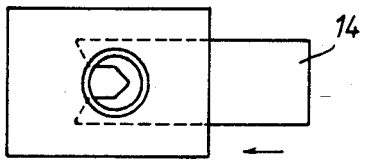
FIG. 3 is a top view of the coagulating liquid flow control unit shown in FIG. 2, showing the plate formed with a notch inserted to restrict the downward-flow of the coagulating liquid (closed state)
Figure 4:
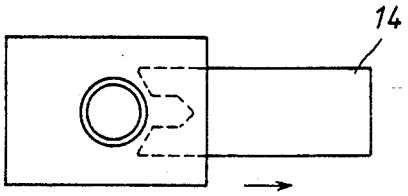
FIG. 4 is a similar top view showing the plate formed with a notch extracted to allow the downward-flow of the coagulating liquid (open state)
Figure 5:
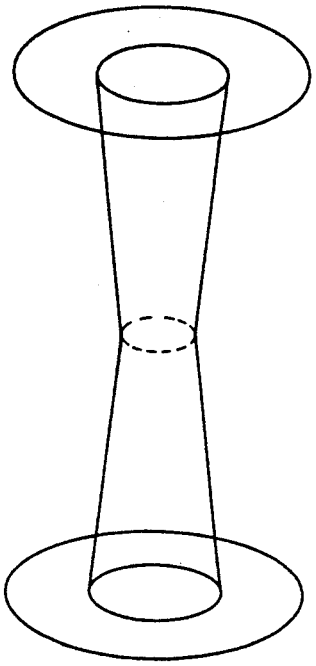
FIG. 5 is a perspective view of another tubular coagulating liquid control valve body of the coagulating liquid flow control unit according to the present invention, in which the neck is located at the middle of the valve body.
Figure 6:
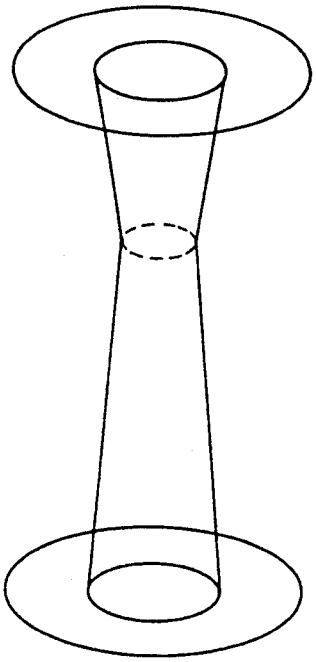
FIG. 6 is a perspective view of still another tubular coagulating liquid control valve body, in which the neck is located at the upper portion away from the middle of the valve body, it being also possible to attach this valve body to the casing upside down.
Figure 7:
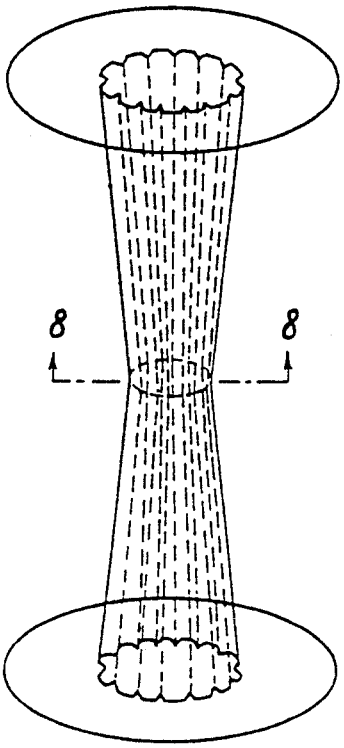
FIG. 7 is a perspective view showing still another tubular coagulating liquid control valve body, in which the valve body is formed with vertical concave and convex portions in the inner surface thereof.
Figure 8:
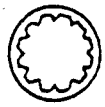
FIG. 8 is a cross-sectional view taken along the line 8—8 shown in FIG. 7.
Figure 9:
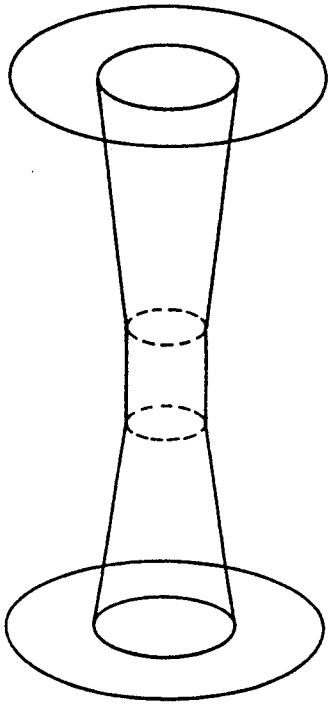
FIG. 9 is a perspective view of still another tubular coagulating liquid control valve body, in which the valve body is formed with a straight portion at the neck thereof.
Figure 10:
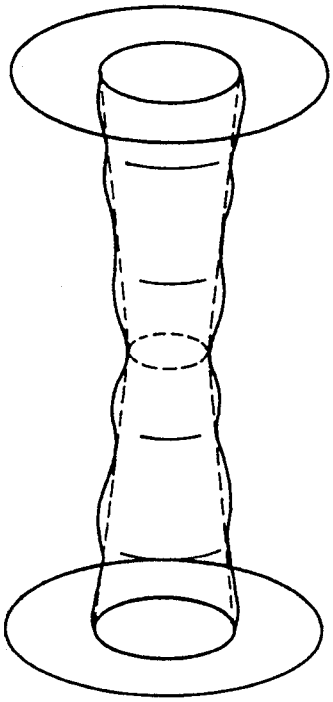
FIG. 10 is a perspective view of still another tubular coagulating liquid control valve body, in which the valve body is formed with smooth stepped portions in the inner surface thereof.

A conventional spinning apparatus, as disclosed in Japanese Published Unexamined Patent Application No. 51-35716, in which a plate with a round notch 14 as shown in FIGS. 2 to 4 is movable horizontally to interrupt the vertical flow of the coagulating liquid, was used to carry out spinning under the same conditions as in Example 1.

When the plate 14 with a round notch was retracted as shown in FIG. 3, since the diameter of the flow pipe 3 at the bottom of the vertical flow type coagulation bath was full opened and therefore the flow rate of the coagulating liquid was excessively large, the liquid level of the coagulating bath 2 was not stably maintained and therefore the spinning operation was disabled. Under the condition that the plate 14 was somewhat inserted as shown in FIG. 3, although the flow rate was reduced a little, the success percentage of the spinning was as low as ⅓ due to the clogging of the flow pipe 3 by the mass of dope with gelled skin. Further, even if successive, vortices of the coagulating liquid were observed immediately before and behind the plate 14 even during the steady state spinning operation. Further, the liquid level stability was not good in the coagulation bath because the liquid level was ruffled. The number of the broken filaments per unit area of the package was 41 filaments/$m^2$, and the strand strength of the carbon fiber obtained by oxidizing and carbonizing this fiber bundle was as low as 524 Kg/$mm^2$.

The spreadability test was also conducted. However, the filament alignment thereof was poor so that it was impossible to smoothly spread the fiber. The above-mentioned test results indicates that in the case of the prior art coagulating liquid flow control unit by which the coagulating liquid is interrupted horizontally with respect to the vertical flow of the liquid, the spinning workability is not only low, but also the filaments are damaged, so that the spreadability and therefore in its turn the physical properties of the fibers are deteriorated.

The effective points of the spinning apparatus and the spinning method according to the present invention can be summarized in comparison with the prior art apparatus and method as follows:

(1) The apparatus has a simple structure and therefore it is possible to retrofit the apparatus to the prior art spinning apparatus;

(2) The apparatus exhibits high performance, i.e. exhibits excellent coagulating liquid flow control characteristics both at the start of spinning and during the steady state spinning operation, passing characteristics of the mass of dope with gelled skin, vertex prevention characteristics of the coagulating liquid, damage prevention characteristics of the coagulated fiber bundle, and effects stability in the liquid level of the coagulation bath;

(3) Since the coagulating liquid flow control unit has no sliding portions with which the coagulating liquid is in contact, the coagulating liquid will not leak;

(4) The spinning operation is simple and the success percentage thereof is as high as almost 100%;

(5) Since no vortices are produced in the flow of the coagulating liquid, the liquid level stability in the coagulation bath is high both at the start of spinning and during the steady state operation;

(6) The spinning operation can be shifted smoothly and quickly to a steady state operation; and (7) The flow rate of the coagulating liquid can be controlled easily.

As described above, in the spinning apparatus of the present invention, there exist various industrial advantages in that the spinning workability is good, the fiber bundle can be protected from being damaged so that the spinning speed is high and therefore the productivity can be improved, and the quality of the fiber products can be improved. In particular, the polyacrylonitrilic filaments obtained by the spinning method according to the present invention are suitable for use as carbon fiber precursor, because of small filament damage, facilitation of the oxidizing and carbonizing processes, improved carbon fiber strength, etc. In addition, it should be noted that the spinning method according to the present invention can be applied to all types of spinning fibers to which the wet spinning method is adoptable, as well as to cellulosic fibers.

What is claimed is:

1. A spinning apparatus for making man-made fibers, said apparatus comprising:

a spinneret;

a container in which a liquid coagulant is contained, said container being disposed beneath said spinneret and having a permanently open bottom through which the liquid coagulant and chemical solution forced through the spinneret are free to flow vertically from the container; and a flow control unit communicating with the permanently open bottom of said container, said flow control unit including a tubular flow control valve body disposed at a level below the bottom of said container and located at such a position that material flowing from the permanently open bottom of the container passes through the interior of the tubular flow control valve body, and a casing forming a chamber around said tubular flow control valve body and which chamber is closed from the interior of the tubular flow control valve body, said tubular flow control valve body being made of an elastomeric material such that the inner diameter of the valve body can be changed by varying the pressure in said chamber.

2. A spinning apparatus as claimed in claim 1, wherein said elastomeric material has a modulus of elasticity of between 3 and 50 Kg/$cm^2$.

3. A spinning apparatus as claimed in claim 1, wherein said elastomeric material is selected from the group consisting of natural rubber and synthetic rubber.

* * * * *